US007073889B2

(12) United States Patent
Van Doorn et al.

(10) Patent No.: US 7,073,889 B2
(45) Date of Patent: Jul. 11, 2006

(54) METHOD OF PRINTING

(75) Inventors: André Van Doorn, Helmond (NL); Marwijn P. T. Christiaans, Eindhoven (NL)

(73) Assignee: Oce-Technologies B.V., Venlo (NL)

( * ) Notice: Subject to any disclaimer, the term of this patent is extended or adjusted under 35 U.S.C. 154(b) by 113 days.

(21) Appl. No.: 10/700,692

(22) Filed: Nov. 5, 2003

(65) Prior Publication Data

US 2005/0052493 A1 Mar. 10, 2005

(30) Foreign Application Priority Data

Nov. 6, 2002 (EP) ..... 02079712

(51) Int. Cl.
*B41J 2/145* (2006.01)

(52) U.S. Cl. ..... 347/41; 347/16
(58) Field of Classification Search ..... 347/41, 347/16, 14; 358/1.2
See application file for complete search history.

(56) References Cited

U.S. PATENT DOCUMENTS 5,992,968 A 11/1999 Uetsuki et al.

FOREIGN PATENT DOCUMENTS

| | | |
|---|---|---|
| EP | 0 513 989 A2 | 4/1992 |
| EP | 0 953 44 A2 | 11/1999 |
| EP | 1 077 134 A1 | 2/2001 |
| EP | 1 201 432 A1 | 5/2002 |
| EP | 1 221 380 A1 | 7/2002 |

*Primary Examiner*—Lamson Nguyen
(74) *Attorney, Agent, or Firm*—Birch, Stewart, Kolasch &Birch, LLP

(57) ABSTRACT

A method of printing pixel images on a sheet or web of paper using an ink-jet printer, said printer having a print head which reciprocates across the sheet or web of paper along a first path in a first direction and along a second path in a second, opposite direction, wherein the pixel image consist of a plurality of pixels located adjacent to each other as viewed in said first and second directions, including first and second pixels to be placed at the leading or upstream edges of the image in question as considered in the first and second directions, wherein the print head is controlled to discharge an ink droplet for forming the first and second pixels only when moving in the first and second directions, respectively and is repeated over the image.

10 Claims, 2 Drawing Sheets

METHOD OF PRINTING

BACKGROUND OF THE INVENTION

This non-provisional application claims priority under 35 U.S.C. § 119(a) on Patent Application No. 02079712.2 filed in Europe on Nov. 6, 2002, which is herein incorporated by reference.

FIELD OF THE INVENTION

The present invention relates to a method of printing, in particular to a method of bi-directional printing. More in particular, the present invention relates to a method of printing using an ink-jet or laserjet printer having a resolution which is at least twice the resolution of the input image.

RELATED ART

Methods are known for allowing a 600 dpi printer to print a 300 dpi bitmap. In printing, a droplet discharged from a print head nozzle to form a pixel has a ball-shaped leading portion and an elongated tail portion. During falling this tail portion may divide itself into two or more droplet parts. Due to the fact that the print head performs a continuous movement during a printing stroke, the ball portion will reach the printing surface, in particular paper, before the tail or other droplet parts will do so. The ball portion hits the paper at the desired location according to a grid based on the higher resolution of the printer to form a pixel. However, the remaining portions of the droplet will hit the paper at locations spaced from the center of the pixel in the direction of movement of the print head and form small satellite pixels.

According to a known method of printing, double pixels for a e.g., 600 dpi resolution are printed using a reciprocating print head having two rows of nozzles arranged perpendicular to the direction of travel, in which, as seen in the direction of travel, the leading row of nozzles is activated for discharging ink droplets to form the pixel located at the trailing side of the double-pixel to be formed. As a result, satellites will hit the paper at the downstream sides of the pixels. The images resulting from this process are blurred or have created vague edges which is unacceptable for 600 dpi printing.

This effect is even more noticeable when printing is performed according to a two pass bi-directional mode, in which, in a first swath, a first part of the leading row of nozzles is activated and in the adjacent, second swath, an adjacent, second part of the trailing row of nozzles is activated. The satellites will appear along the edges of the row of double-pixels in the first swath only, resulting in more or less step-like edges which intensifies the irregular appearance of the edges of the image.

In an attempt to find a solution to this problem it has been proposed to lower the speed of travel of the print head so as to decrease the distance between the location of the center of the pixel formed by the ball portion of the droplet and the location where the tail portion(s) of the droplets hit(s) the paper. In this solution, however, the printing time would increase resulting in less printing efficiency.

SUMMARY OF THE INVENTION

An object of the present invention is to improve on the known methods.

A further object of the present invention is to provide a method of printing double or multiple pixels having sharp edges on both sides.

Yet another object of the invention is to provide a method of two pass bi-directional printing at a high frequency resulting in a high resolution image with sharp edged double or multiple pixels.

From one aspect according to the present invention, these and other objects are realized by a method of printing pixel images on a sheet or web of paper using an ink-jet or laserjet printer, wherein the printer has means for storing an input image corresponding to the pixel image in the form of a first grid of imaginary lines according to a first resolution, and the printer is adapted to print the pixel image in the form of a second grid of imaginary lines according to a second resolution which is a plurality of the first resolution. The printer has a print head with at least one nozzle and is provided with control means which operates the print head in accordance with the input image recorded in the storing means. The print head reciprocates across the sheet or web of paper along a first path in a first direction and along a second path in a second, opposite direction, wherein the pixel image has first pixels located at a first edge which forms an upstream edge with respect to the movement of the print head in the first direction and second pixels located at a second edge which forms an upstream edge with respect to the movement of the print head in the second direction. All first pixels at the first edge are printed through activation of the print head nozzle by the control means to discharge an ink droplet at a line of the second grid which coincides with the first edge at that location when moving in the first direction, and all second pixels at the second edge are printed through activation of the print head nozzle by the control means to discharge an ink droplet at a line of the second grid which coincides with the second edge at that location when moving in the second direction.

From a second aspect, the present invention provides a method of printing pixel images on a sheet or web of paper using an ink-jet or laserjet printer, wherein the printer has a resolution which is a plurality of the resolution of the input image, the printer has a print head which reciprocates across the sheet or web of paper along a first path in a first direction and along a second path in a second, opposite direction, the pixel images consist of a plurality of pixels located adjacent to each other as viewed in said first and second directions, including first and second pixels to be placed at the leading or upstream edges of the image in question as considered in the first and second directions, and wherein the print head is controlled to discharge an ink droplet for forming the first and second pixels only when moving in the first and second directions, respectively.

In the method according to the present invention, the satellites will always hit the paper at a location which is within the intended area of the double or multiple pixel, in other words in the area which is indeed to be covered by ink. As a result, the edges of the printed image will be sharp, without requiring the printing speed to be decelerated.

In a further embodiment, the second or printer resolution is twice the first or input image resolution, in particular 600 dpi.

In an advantageous embodiment of the method according to the present invention, use is made of a print head having a first and a second row of nozzles arranged according to lines transverse to said first and second directions, wherein said first row of nozzles is located at the downstream side of the print head when moving in the first direction, and the second row of nozzles is located at the downstream side of the print head when moving in the second direction, the first pixels are printed by activating the first row of nozzles and the second pixels are printed by activating the second row of nozzles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1A:
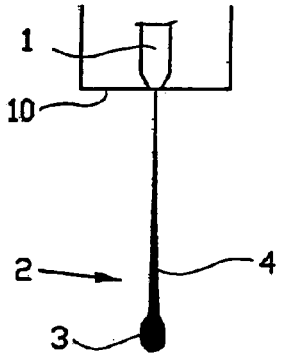
FIG. 1A schematically shows the discharge of an ink droplet from a nozzle of a print head.
Figure 1B:
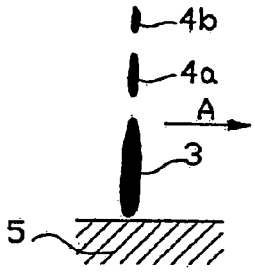
FIG. 1B schematically shows the droplet just before hitting a sheet of paper.
Figure 1C:
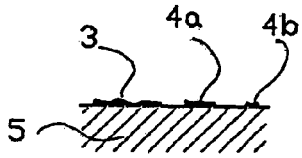
FIG. 1C schematically shows the components parts of the ink droplet as it contacts the paper sheet.

In FIG. 1A the ink-jet or laserjet printer head 1 is shown during the discharge of an ink droplet 2 from nozzle 10. The droplet 2 has a lower,ball-shaped portion 3 and an elongated tail portion 4. After having travelled downwardly for a short period of time, the droplet 2, in particular the tail portion 4, will break up into two or more tail parts 4*a* and 4*b*, as shown in FIG. 1B. The print head 1 travels in the direction A with respect to the papersheet 5, as result of which the ball portion 3 and the tail parts 4*a*, 4*b* will hit the papersheet 5 at location spaced from each other in the direction A, as shown in FIG. 1C.

Figure 2A:
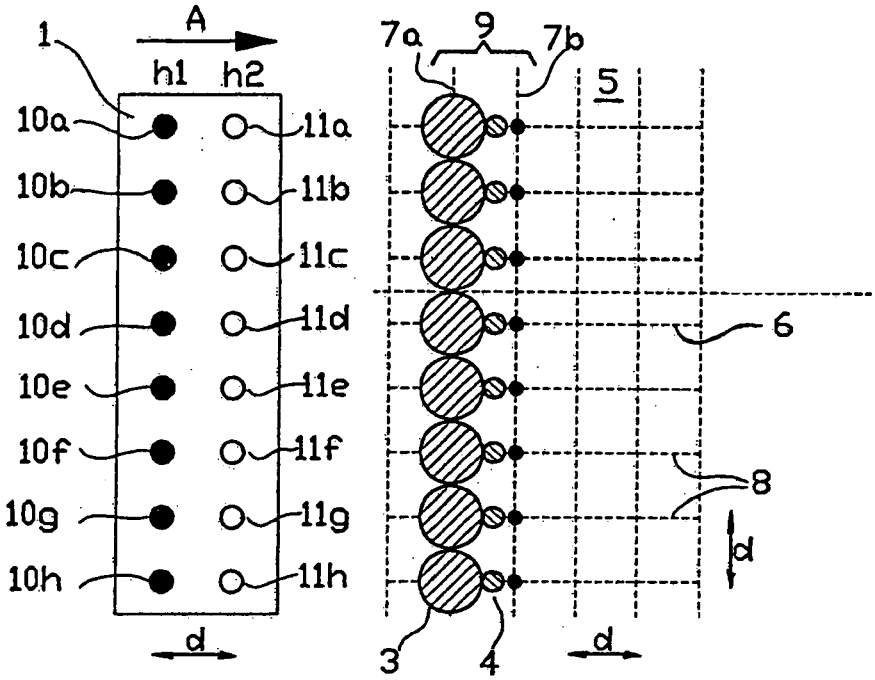
FIGS. 2A and 2B diagrammatically show the application of double-pixels in two steps.

In FIG. 2A the printer head 1 is schematically shown having two rows $h_1$, $h_2$ of nozzles 10*a–h* and 11*a–h*, which rows are spaced at a distance d from each other.

Figure 2B:
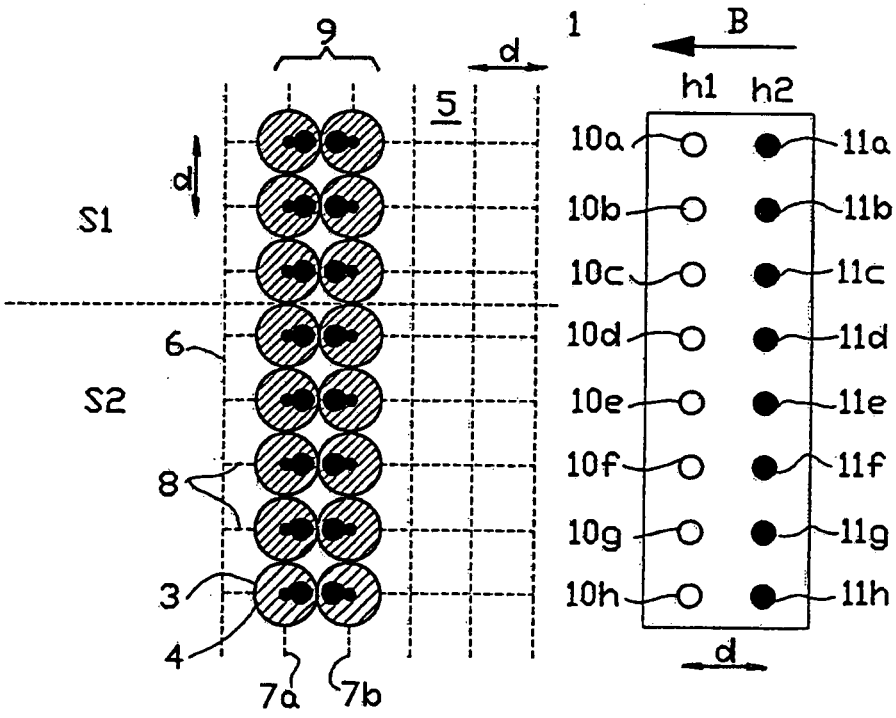

Also in FIG. 2A is shown the paper sheet 5 from above, as well as an imaginary grid 6 of gridlines 7 and gridlines 8, which are spaced from each other at a distance d. In this example, which corresponds to a 600 dpi, D is 1/600 inch. FIGS. 2A and 2B show the process in the so called two path bidirectional printing. According to this process, printing of images is carried out in two overlapping swaths. A first swath in a direction from left to right (A) and in the second overlapping swath in the opposite direction (B). Accordingly nozzles 10*a–h* and 11*a–h* are active in the first swath and nozzles 10*a–h* and 11*a–h* are active in the second swath.

When the printer head 1 is moved in the direction A, the —not shown-control system of the printer activates the nozzles 10*a–h* to discharge ink droplets 2 such that the ball portion 3 of the ink droplets will hit the paper sheet 5 at line 7*a* of the grid 6. The tail parts 4*a*, 4*b* or satellites will hit the paper sheet 5 at the down stream side of the ball portions 3.

Figure 3:
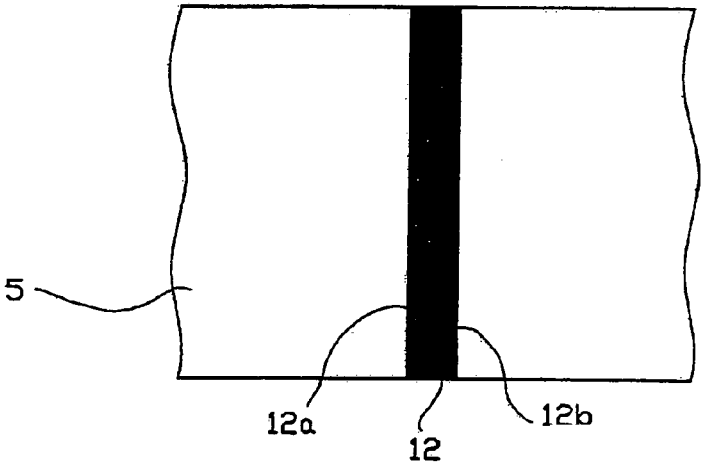
FIG. 3 shows a portion of a line printed by using the method according to the present invention.

In the return stroke, depictured in FIG. 2B, the printer head 1 is moved back in the direction B, and in this case the printer head 1 is activated to have the nozzles 11*a–h* discharge ink droplets 2 such that the ball portions 3 of the ink droplets hit the paper sheet 5 at the grid line 7*b*. The satellites 4*a*, 4*b* will hit the paper in area between lines 7*a* and 7*b*. In this way a series of double pixels 9 is formed, forming, in this example, a line forming image as if it were a series of 300 dpi pixels. Due to the fact that the satellite will always hit the paper sheet 5 within the double pixels, the outer edges of each line will be sharp and an image containing a number of lines will be sharp also. This is shown in FIG. 3 by means of line 12 having sharp edges 12*a* and 12*b*.

Figure 4:
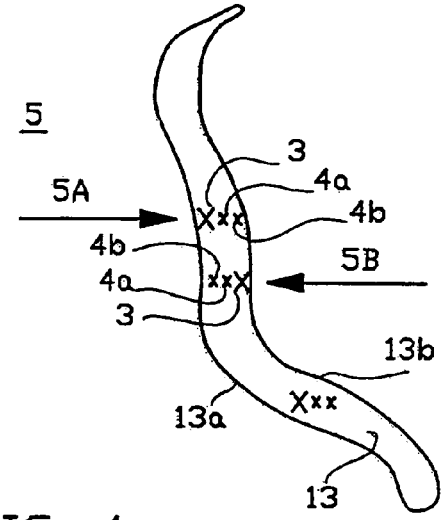
FIG. 4 shows another image that can be obtained by the method according to the present invention.

In FIG. 4, it is shown that any image can be printed using the method according to the invention. Every image may have a dimension in moving direction of the printer head corresponding to a double pixel. Every image (600 dpi) is converted into an image of double pixels, the double pixels forming an image of 300 dpi. Even without knowing the exact outlines of an image part of the present invention, ensures that the satellite pixels all will fall within the double pixel boundaries. In all these cases, the printer head is activated such that the ink droplets that are required for forming the boundary lines 13*a*, 13*b*, of image 13, are discharged when the printer head moves in a direction A and B, respectively, with a result that the satellites 4*a*, 4*b* always hit the paper sheet in an area between the lines 13*a* and 13*b*.

The present invention is described with an inkjet head having two rows of nozzles (10*a–h*; 11*a–h*) but also a head having a single row can be used for the present invention.

The invention being thus described, it will be obvious that the same may be varied in many ways. Such variations are not to be regarded as a departure from the spirit and scope of the invention, and all such modifications as would be obvious to one skilled in the art are intended to be included with the scope of the following claims.

What is claimed is:

1. A method of printing pixel images on a sheet or web of paper using an ink-jet printer having a print head which reciprocates across the sheet or web of paper along a first path in a first direction and along a second path in a second, opposite direction, wherein the pixel image consist of a plurality of pixels located adjacent to each other, as viewed in said first and second directions, including first and second pixels placed at the leading or upstream edges of the image in question as considered in the first and second directions, wherein the print head is controlled to discharge an ink droplet for forming the first and second pixels only when moving in the first and second directions, respectively and is repeated over the image, said ink-jet printer containing means for storing an input image corresponding to the pixel image according to a first or input image resolution and being adopted for printing said pixel image according to a second or printing resolution, said second or printing resolution being twice the first or input image resolution, in particular 600 dpi.

2. The method according to claim 1, wherein the pixel image is line-shaped.

3. The method according to claim 1, wherein use is made of a print head having a first and a second row of nozzles arranged according to lines transverse to said first and second directions, wherein said first row of nozzles is located at the downstream side of the print head when moving in the first direction, said second row of nozzles is located at the downstream side of the print head when moving in the second direction, and wherein the first pixels are printed by activating the first row of nozzles and the second pixels are printed by activating the second row of nozzles, said ink-jet printer containing means for storing an input image corresponding to the pixel image according to a first or input image resolution and being adopted for printing said pixel image according to a second or printing resolution, said second or printing resolution being twice the first or input image resolution, in particular 600 dpi.

4. A method of printing pixel images on a sheet or web of paper using an ink-jet printer containing means for storing an input image corresponding to the pixel image in the form of a first grid of imaginary lines according to a first resolution, said printer being adapted for printing said pixel image in the form of a second grid of imaginary lines according to a second resolution which is a plurality of the first resolution, said printer having a print head with at least one nozzle, wherein said printer is provided with control means for operating the print head in accordance with the input image recorded in the storing means, said print head reciprocating across the sheet or web of paper along a first path in a first direction and along a second path in a second, opposite direction, wherein said pixel image has first pixels located at a first edge which forms an upstream edge with respect to the movement of the print head in the first direction and has second pixels located at a second edge which forms an upstream edge with respect to the movement of the print head in the second direction, wherein all first pixels at said first edge are printed through activation of the print head nozzle by the control means to discharge an ink droplet at a line of the second grid which coincides with the first edge at that location, when moving in the first direction, and wherein all second pixels at said second edge are printed through activation of the print head nozzle by the control means to discharge an ink droplet at a line of the second grid which coincides with the second edge at that location when moving in the second direction.

5. The method according to claim 4, wherein the second or printer resolution is twice the first or input image resolution, in particular 600 dpi.

6. A method of printing an image on a recording medium using an ink jet printer having a print head with at least one nozzle for discharging ink droplets, wherein first pixels are printed by selectively discharging ink droplets in first swaths in a first direction and wherein second pixels are printed by selectively discharging ink droplets in second swaths in a second direction opposite to the first direction, and wherein if an ink droplet is discharged in a first swath, giving rise to a main first pixel, then an ink droplet is discharged in a second swath overlapping the first swath, giving rise to a main second pixel adjacent to and placed upstream from the main first pixel, when considered in the second direction, for forming a double pixel.

7. The method of printing an image as claimed in claim 6, wherein the ink droplet is discharged in the first swath giving rise to satellite first pixels placed downstream from the main first pixel when considered in the first direction, the ink droplet discharged in the second swath giving rise to satellite second pixels placed downstream from the main second pixel when considered in the second direction, said satellite first and second pixels being placed within the external edges of the formed double pixel.

8. The method of printing an image as claimed in claim 6, using a print head with at least one row of nozzles arranged according to a line orthogonal to the first direction, wherein a group of first pixels is printed in a first swath according to a first grid of first imaginary lines orthogonal to the first direction and equidistantly spaced by a distance 2*d*; and a group of second pixels is printed in a second swath according to a second grid of second imaginary lines equidistantly spaced by a distance 2*d* and substantially parallel to the first imaginary lines, the first and second grids being interlaced such that the distance between each first imaginary line and a closest neighboring second imaginary line is d.

9. The method of printing an image as claimed in claim 8, wherein the print head having a first row of nozzles and a second row of nozzles substantially parallel to each other are spaced by a distance d, the group of first pixels being printed by ejecting ink droplets from the first row of nozzles and the group of second pixels being printed by ejecting ink droplets from the second row of nozzles.

10. The method of printing an image according to claim 9, wherein the printer has means for storing a bitmap input image having an input image resolution, and control means for operating the print head in accordance with the bitmap input image stored in the storing means, the printer resolution along a line parallel to the first direction being twice the input image resolution.

* * * * *